United States Patent [19]

Groves, Jr.

[11] 4,192,499

[45] Mar. 11, 1980

[54] LOOPED SLIDE

[76] Inventor: Kenneth L. Groves, Jr., 1909 Fifth St., Ceres, Calif. 95307

[21] Appl. No.: 870,199

[22] Filed: Jan. 17, 1978

[51] Int. Cl.[2] ..... A63G 21/02

[52] U.S. Cl. ..... 272/56.5 R; 104/69

[58] Field of Search ..... 272/56.5 R, 56.5 SS; 104/55, 54, 56, 57, 69, 63, 68, 77, 78, 134, 135, 136, 138 R, 138 G, 73, 53, 82, 155; 193/1 Z, 2 R; 182/48; D34/5 E; 243/38; 302/19, 54; 138/118, 178; 46/43

[56] References Cited

U.S. PATENT DOCUMENTS

| | | | |
|---|---|---|---|
| 727,221 | 5/1903 | Smith | 104/55 |
| 1,124,629 | 1/1915 | Lilienfeld | 104/69 |
| 1,276,115 | 8/1918 | Richardson | 104/138 R X |
| 1,754,375 | 4/1930 | Sturges | 272/56.5 R UX |
| 1,906,763 | 5/1933 | Maynes | 104/53 |
| 2,465,187 | 3/1949 | Barrabee | 272/56.5 R |
| 3,343,793 | 9/1967 | Waser | 104/69 X |
| 3,352,512 | 11/1967 | James, Sr. | 104/155 X |
| 3,469,340 | 9/1969 | Breneman et al. | 104/155 X |
| 3,525,482 | 8/1970 | Kramer | 243/38 |
| 3,697,071 | 10/1972 | Anderson | 104/155 X |

FOREIGN PATENT DOCUMENTS

| | | | |
|---|---|---|---|
| 18678 | of 1901 | United Kingdom | 104/55 |
| 1,451,768 | 10/1976 | United Kingdom | 272/56.5 R |

*Primary Examiner*—Richard C. Pinkham
*Assistant Examiner*—Arnold W. Kramer
*Attorney, Agent, or Firm*—Jack L. Bohan

[57] ABSTRACT

An amusement device having a curved-loop, slide element causing the rider thereof to undergo a portion of his travel in the inverted position. The slide is tubular with a generally circular cross sectional wall, and at least the upper portion of the cross sectional wall may be transparent. The upper inlet end of the slide may have an air blower to assist in maintaining the speed of the user. Downstream of the loop is a decelleration section.

8 Claims, 6 Drawing Figures

FIG I

LOOPED SLIDE

BACKGROUND OF THE INVENTION

1. Field of the Invention

The present invention relates to a slideway amusement device for use in amusement parks, and the like, and more particularly to a device which contains a curved-loop element causing the rider thereof to undergo a portion of his travel in the slide in the inverted position.

2. Description of the Prior Art

A wide variety of slideways have been described in the past performing various utilitarian or entertainment functions. An example of the utilitarian slide is that shown in U.S. Pat. No. 1,754,375 issued to A. H. Sturges on Apr. 15, 1930. Described therein is a slideway of a spiral design used as a fire escape in multi-story buildings and in particularly in school buildings. The device can be provided with a multitude of openings so as to permit access from various floors in the building. One riding in the slideway will be subject to a continued descending movement from the port of entry to the point of exit and remains in a substantially upright sitting position during the course of travel through the slideway.

An example of a slideway device used for amusement purposes is shown in U.S. Pat. No. 803,119 issued to W. H. Logan on Oct. 31, 1905. Here a spiral slideway secured within an outer cage is provided for the amusement of the riders entering the spiral at its uppermost portions and sliding down the slide to its point of exit at ground level. Again in this device the rider proceeds from the uppermost portion of the slideway to the lowermost portion in a substantially upright sitting position and at no time undergoes any portion of his travel in the inverted position. A further example of an amusement slideway is that shown in U.S. Pat. No. 1,511,139 issued on Oct. 7, 1924, to L. Roziger. In this device a chute is provided in the form of a helix causing a primary movement of the rider in a helical line during the course of descent. However, in this particular case the chute is not fixed and rotates about a central axis so that the person is also carried in a circle or part of a circle during the course of his helical travels. However, at no time does the rider experience inverted travel in the course of his descent.

The above are simply exemplary of the prior art showing various slideway devices and in particular those having a spiral pathway during the course of travel of the individual rider upon the slideway.

SUMMARY OF THE INVENTION

A preferred embodiment made in accordance with the principles of the present invention utilizes a slideway constructed of three basic portions, comprising first: an acceleration element wherein the rider is accelerated to a desired velocity; a loop element wherein the rider is caused to pass through the loop by centrifugal action; and finally a deceleration element wherein the rider is decelerated to a point of exit after having gone through the loop element.

DETAILED DESCRIPTION

Figure 1:
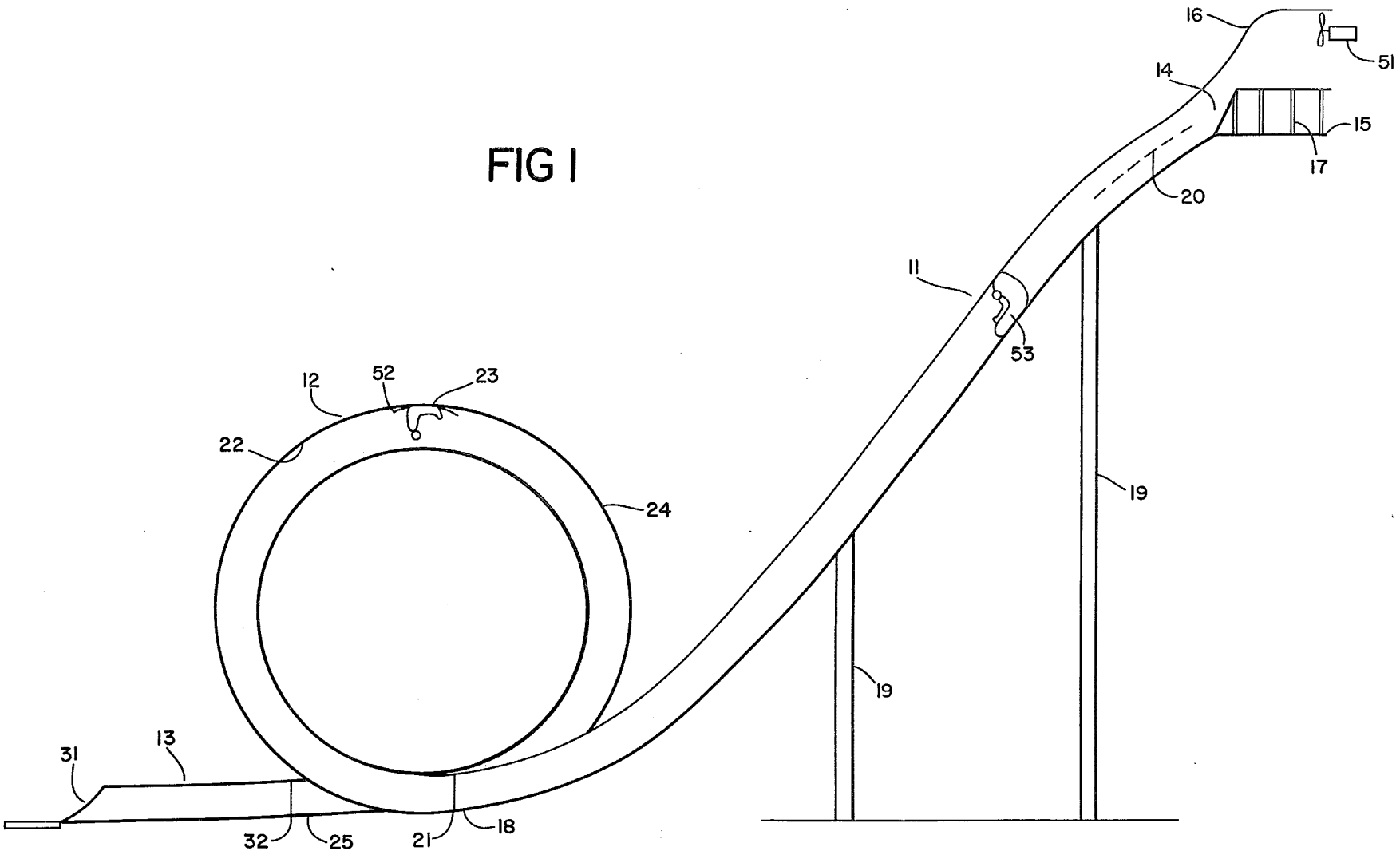
FIG. 1 is a side-elevation view of the device of the present invention.

Referring by numerals to the accompanying drawings, which illustrate a preferred embodiment of the device, in FIG. 1 there is shown the acceleration element 11, the loop element 12 and the deceleration element 13. At the upper end of the acceleration element 11 there is a first opening to provide a point of entry by the individual rider. The rider enters this opening 14 from platform 15 which is reached by an appropriate means such as a ladder or elevator. The first opening 14 is connected to a protective hood member 16 to permit entry without falling off the platform. In addition, railing 17 is provided in connection with the platform 15 at first opening 14 for the rider's protection upon entry into the first opening. The rider assumes a sitting position and proceeds down the lower inside surface of the acceleration element 11 quickly gaining speed and reaching a maximum velocity at a second position or opening 18 at the lowest portion of the acceleration element 11. The first opening 14 is located at a first elevation and the second opening 18 is located at a second elevation providing the individual rider with a predetermined velocity upon reaching the second elevation. This velocity is dependent primarily upon the relative elevations of the first and second elevations and the coefficient of friction of the surface of the acceleration element. Upon leaving acceleration element 11 the rider enters into the loop element 12 at the entrance opening 21 of the loop. The second opening 18 and the entrance opening 21 are coincidental and in alignment so that there is a smooth transition from the acceleration element 11 to the loop element 12. The term "opening" as used in the terms second opening and entrance opening are for the purpose of describing the invention herein and are not actual openings to the outside. In fact, in actual construction, there may be no interface or break at this point whatsoever and the acceleration element 11 and the loop element may be one continuum of material. The individual rider upon reaching entrance opening 21 proceeds to ride upward on the loop on the outermost inside surface 22 thereof eventually reaching the top of the loop element 23 at which point the rider will be in a completely inverted position. However, due to contrifugal forces, the rider is caused to maintain a continued contact with the outermost inside surface 22 of the loop element 12 throughout the entire ride through the loop element 12. The ride proceeds down the back side 24 of loop element 12 and assumes an upright position by the time he reaches the exit opening 25. Since the individual rider will still be travelling at a predetermined velocity, a deceleration element 13 is provided. The deceleration element 13 has a terminal opening 31 which opens onto an exit platform so that the rider may stand up and walk away from the tube opening to make way for a following rider. The deceleration element 13 has a further opening 32 which is coincidental to and in complete alignment with the exit opening 25 of the loop element 12. The further opening 32 is likewise at the third elevation as is the exit opening 25. The terminal opening 31 is that of fourth elevation which can be at the same elevation as the third elevation or above or below said third elevation, depending upon the length of the tube and the coefficient of friction thereof. Again the term "opening" as used in the terms further opening and exit opening are for descriptive purposes only and there may, in fact, be no line of demarcation between the loop element 12 and the deceleration element 13 for such elements can be constructed of one continuum.

Figure 2:
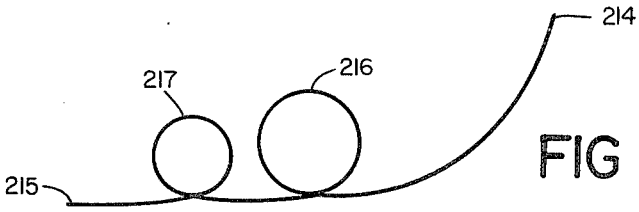
FIG. 2 shows in a diagrammatic form an elevation side view of the center line of an alternative design of the present invention.
Figure 3:
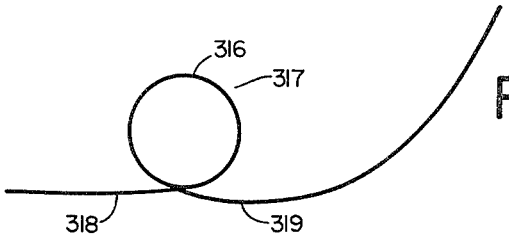
FIG. 3 shows in diagrammatic form a side-elevation view of a futher alternative design of the present invention.
Figure 4:
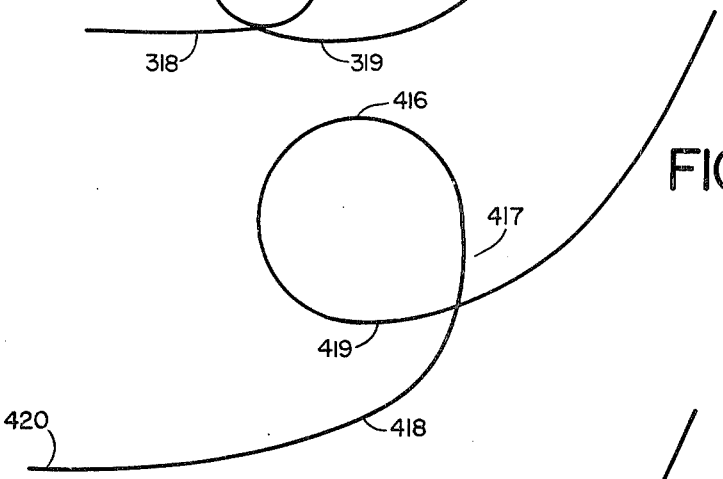
FIG. 4 shows in diagrammatic form a side-elevation view of an alternative design of the present invention.
Figure 5:
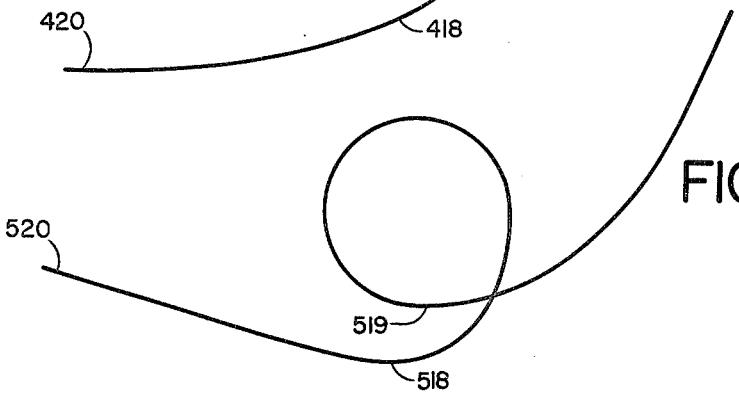
FIG. 5 shows a side-elevation view in diagrammatic form of a further alternative design of the center line of a device of the present invention.

Appropriate support devices, such as 19, are provided as appropriate to support and stabilize the three elements. The center line 20 of the three elements follows a single-loop configuration in the design of FIG. 1. However, as shown diagrammatically in FIGS. 2 through 5, the center line of the elements may take various configurations to effect various purposes. For example, there is shown in FIG. 2 the center line of various elements arranged so as to provide a double-loop configuration having a point of entry 214 and a point of exit 215. The elevation at the top of loop 216 must necessarily be higher than the elevation of the top of loop 217 in order to compensate for friction losses. The side-elevation view of the center line design of FIG. 3 provides for a tight turn at point 317 of loop 316, and with a third elevation 318 substantially higher than a second elevation 319. In the center-line design shown in FIG. 4, the rider undergoes a virtually vertical descent in portion 417 of loop 416, picking up considerable speed just shortly before terminating the ride. In this design the third elevation 418 is considerably lower than the second elevation 419. In order to allow additional deceleration due to friction, the length of travel along the center line of 420 is lengthened in order to provide for a longer deceleration element and greater deceleration due to friction. Another means for deceleration in those designs wherein the third elevation is lower than the second elevation, is shown in FIG. 5, wherein the third elevation 518 is lower than the second elevation 519 and in addition is lower than the fourth elevation 520. Accordingly, deceleration is accomplished by gravitational effects while the rider passes from elevation 518 to elevation 520.

Referring to FIG. 1 there is shown a fan and motor 51 in the area of the first opening where the rider first enters into the slideway of the present invention. Because of the considerable length of travel of the rider through the slideway of the present invention, considerable air friction can be encountered which will decelerate the rider to the point that sufficient velocity to develop the required centrifugal forces may be difficult. Accordingly, by providing a fan at the upper opening, air flow can be maintained as desired so as to minimize air friction. With sufficient fan power it is feasible that air fricton can actually be reduced to zero or take on a negative value, since the rider will be boosted by the force of the air across his back as he proceeds through the slideway apparatus.

A safety feature of the present device is that in the event the rider does not attain sufficient velocity to develop sufficient centrifugal forces to hold him against the outermost inside surface of the loop element causing him to fall, he will be able to catch himself due to the tubular configuration of the slideway in the loop element 12. If he falls off prior to reaching the apex of the loop, he will then eventually wind up in the vicinity of the second elevation and, accordingly, it is desirable to provide a trapdoor or hatch in that vicinity so that a rider may exit without having to crawl all the way back to the top of the acceleration element 11. For safety purposes it is imperative that the design be of tubular configuration in the loop portion, and it is desirable that the acceleration element likewise be of tubular configuration to avoid inadvertent falling from the high heights of the acceleration element 11. It is desirable to construct the slide of the present invention from a transparent material such as a thermoplastic material or other plastic substances of sufficient hardness and durability, such a plexiglass. Having the device made of a transparent material permits spectators to observe the travel of various riders through the course of the slide, and provides enjoyment and amusement to the observers as well as the rider.

Since the individual riders will not be uniformly clothed, the coefficient of friction may not necessarily be uniform from one rider to the next. Accordingly, it is desirable to provide each rider with an appropriate material 52 to sit on so that the coefficient of friction is substantially uniform from one rider to the next. In addition, certain materials may be sprinkled on the surface of the slide or undeneath the cloth 52 in order to further reduce the coefficient of friction. Dance floor compounds, and the like, will be suitable for such pruposes. In those cases where a fan 51 is provided of sufficient capacity to provide air flow velocities through the tubular structure in excess of the rate of travel of the rider, thereby imparting additional acceleration forces to the rider, it may be desirable to provide the rider with means for increasing the surface area of his back. For example, a triangular piece of material may be provided for sitting upon, and two corners can be held by the hands over head so as to increase the over-all area in the manner of a sail for picking up the air flow from fan 51. As an alternative the rider can be provided with a beanbag type riding device 53 which would spread completely across the cross-section of the tubular elements. Using high-fan forces as referred to above, this would produce added acceleration to the rider and would permit the first elevation to be substantially lower. With the right fabric for lining the beanbag so as to minimize the friction with the tube, and with a sufficiently powerful fan, the first opening could be at an elevation approaching that of the second elevation.

Figure 6:
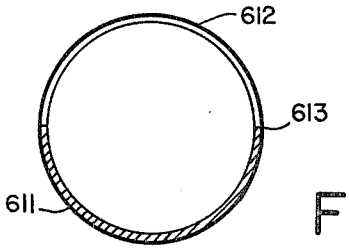
FIG. 6 shows a cross-sectional view of an alternative structural design of the present invention.

Although there has been shown and described a particular embodiment of this invention, it will be obvious to those skilled in the art that various changes and modifications may be made therein without departing from the invention. For example, as shown in FIG. 6, the tubular structure may be comprised of two different materials with the bottom portion 611 being made of a metallic material such as stainless steel, and the upper portion being made from a transparent plastic material. The materials can be joined at their interface 613 by appropriate fasteners or adhesives.

I claim:

1. A slideway amusement device for conveying a person in a sitting posture from a first position to a second position by low-friction, sliding contact with said device comprising an acceleration element having a smooth sliding-contact surface, at least one tubular, vertical looping element substantially circular in cross-section and having a smooth sliding-contact surface, and a deceleration element having a smooth sliding-contact surface.

2. An amusement device as in claim 1 wherein the acceleration element is comprised of a substantially linear tube with a first opening at a first elevation and a second opening at a second elevation, and the loop element is comprised of a tube forming a single loop having an entrance opening at said second elevation in alignment with said second opening and an exit opening at a third elevation, said second elevation being sufficiently lower than said first elevation to permit acceleration of a person to a velocity sufficient to cause continued contact of the person with the outermost inside surface of the loop element.

3. An amusement device as in claim 2 wherein the deceleration element is comprised of a member having a terminal opening at a fourth elevation and a further opening at said third elevation in alignment with said exit opening of the loop element, the relative elevations of the third and fourth elevations being such as to permit deceleration of the person to approximately zero velocity upon reaching said terminal opening.

4. An amusement device as in claim 3 wherein the acceleration element, the loop element and the deceleration element are substantially fabricated from a transparent material.

5. An amusement device as in claim 3 wherein the elements are fabricated from a metallic material in the lower portion thereof and a clear material in the upper portion thereof.

6. An amusement device as in claim 5 wherein the elements are comprised of segmented sections having means for joining one section to the next.

7. An amusement device as in claim 1 wherein the acceleration element is comprised of a tubular member and air pressurizing means whereby the person is accelerated to a velocity such that during passage through the tubular looping element centrifugal forces exist to cause continued contact of the person with the outermost inside surface of the loop element.

8. An amusement device as in claim 7 wherein the deceleration element constitutes a tubular element with a coefficient of friction and a horizontal angle such that it will bring the person to a stopped condition upon reaching said second position.

* * * * *